US006968688B2

(12) United States Patent
Gimsa

(10) Patent No.: US 6,968,688 B2
(45) Date of Patent: Nov. 29, 2005

(54) TWO-CYCLE HOT-GAS ENGINE

(75) Inventor: Andreas Gimsa, Werder (DE)

(73) Assignee: Enerlyt Potsdam GmbH, Potsdam (DE)

( * ) Notice: Subject to any disclaimer, the term of this patent is extended or adjusted under 35 U.S.C. 154(b) by 115 days.

(21) Appl. No.: 10/271,014

(22) Filed: Oct. 15, 2002

(65) Prior Publication Data

US 2003/0074882 A1 Apr. 24, 2003

(30) Foreign Application Priority Data

| | | |
|---|---|---|
| Oct. 24, 2001 | (DE) | 101 53 772 |
| Apr. 5, 2002 | (DE) | 102 16 190 |
| Aug. 28, 2002 | (DE) | 102 40 347 |
| Aug. 29, 2002 | (DE) | 102 40 750 |

(51) Int. Cl.[7] ..... F02G 1/044

(52) U.S. Cl. ..... 60/526; 60/289; 60/516; 60/525; 417/379; 92/146; 91/508

(58) Field of Search ..... 417/379; 92/146; 91/508; 123/550, 551; 60/289, 516, 524, 60/525, 526, 39.6

(56) References Cited

U.S. PATENT DOCUMENTS

| | | | | |
|---|---|---|---|---|
| 1,356,427 A | * | 10/1920 | Braunstein | 165/160 |
| 2,183,893 A | * | 12/1939 | Price | 122/250 R |
| 2,616,245 A | * | 11/1952 | Van Weenan | 60/525 |
| 2,651,294 A | * | 9/1953 | Horne | 122/134 |
| 2,657,528 A | * | 11/1953 | Jonkers et al. | 60/526 |
| 2,657,553 A | * | 11/1953 | Jonkers | 62/6 |
| 3,813,882 A | * | 6/1974 | Hubschmann | 60/525 |
| 3,835,294 A | * | 9/1974 | Krohn et al. | 392/484 |
| 3,848,413 A | * | 11/1974 | Gothberg | 60/525 |
| 3,990,246 A | * | 11/1976 | Wilmers | 60/707 |
| 3,994,136 A | * | 11/1976 | Polster | 60/518 |
| 4,199,945 A | * | 4/1980 | Finkelstein | 60/520 |
| 4,209,061 A | * | 6/1980 | Schwemin | 165/10 |
| 4,357,909 A | * | 11/1982 | Kagoshima | 122/183 |
| 4,622,813 A | * | 11/1986 | Mitchell | 60/522 |
| 5,365,888 A | * | 11/1994 | Aronov | 122/18.4 |
| 5,822,964 A | * | 10/1998 | Kerpays, Jr. | 60/523 |
| 6,435,174 B1 | * | 8/2002 | Spilde et al. | 126/378.1 R |

FOREIGN PATENT DOCUMENTS

| | | | |
|---|---|---|---|
| JP | 356077537 A | * | 6/1981 |
| WO | WO 01/12970 A1 | * | 2/2001 |

* cited by examiner

*Primary Examiner*—Timothy S. Thorpe
*Assistant Examiner*—Emmanuel Sayoc
(74) *Attorney, Agent, or Firm*—Merchant & Gould

(57) ABSTRACT

A two-cycle hot-gas engine comprising an expansion piston in a heatable cylinder member and a compression piston in a coolable cylinder member. The expansion piston and the compression piston are disposed along a common axis.

16 Claims, 13 Drawing Sheets

TWO-CYCLE HOT-GAS ENGINE

The invention relates to the field of hot-gas engines.

Hot-air engines operating according to the Stirling principle are among the earliest thermal engines. The efficiency which Stirling type or similar hot-gas engines offer, in principle, is higher than that of steam engines, Diesel or Otto carburetor engines. Hot-gas engines supply heat to a working gas heater without the need for combustion inside a cylinder. Together with the high efficiency, the possible use of renewable fuels and the continuous combustion offered, this guarantees ecological energy efficiency.

Hot-gas engines operating according to the Stirling principle are known as alpha, beta, and gamma types. With the alpha type, the total working gas volume is influenced by movements of an expansion piston and a compression piston. In the case of the beta and gamma types, a displacer moves in a constant volume space and the total gas volume is influenced by the working piston alone.

In spite of the efficient energy conversion provided by hot-gas engines, such engines are not yet widely used to generate mechanical energy.

It is, therefore, an object of the instant invention to provide an improved two-cycle hot-gas engine of the alpha type which is of simple structure and permits flexible use and enduring operation in various fields of application.

This object is met, in accordance with the invention, in a two-cycle hot-gas engine comprising an expansion piston in an expansion cylinder member and a compression piston in a compression. cylinder member, wherein the expansion and compression pistons are disposed along a common axis.

An essential advantage obtained by the invention over prior art engines resides in the provision of an engine structure for a two-cycle hot-gas engine of the alpha type which offers high power density in spite of its structural simplicity. The engine proposed by the invention disposes of structural parallels with the beta type, combining them with the advantages of a double-acting engine of the alpha type. Due to their in-line operation, the pistons allow for a slender gear transmission and a corresponding crankcase to be built. The crosstail or sectional rail slide of both connecting rods may share the same guide.

No heat flow is induced inside a cylinder member since the temperature is the same. That applies to both the cylinder member wall and the pistons. Consequently, close approximation to isothermal conditions is achieved.

It is another advantage of the invention that openings in the cylinder wall for passage of the piston rod can be provided at the cool end, namely the compression cylinder member, where it is easy to seal them.

Moreover, the phase shift between the expansion and compression pistons can be adjusted voluntarily. The expansion volume can be varied with respect to the compression volume.

Furthermore, the symmetrical relationships of the expansion and compression pistons can be exploited advantageously for free-piston arrangements. Engines thus can be built which are pressure resistant and absolutely pressure tight.

The two opposed cycles offered by the hot-gas engine designed according to the invention make it possible to carry out control via cycle shortcircuiting. The piston forces are small because of the two opposed cycles, even when the gear transmission is pressureless.

According to a convenient further development of the invention the expansion piston and the compression piston are disposed so as to operate in alignment one behind the other. That makes it possible to give both pistons and their corresponding cylinder members the same design diameter.

In another embodiment of the invention, first gas chambers formed at a bottom end of the compression piston in the compression cylinder member and at a bottom end of the expansion piston in the expansion cylinder member communicate through a first heater, a first regenerator, and a first cooler, and second gas chambers formed at a top end of the compression piston in the compression cylinder member and at a top end of the expansion piston in the expansion cylinder member communicate through a second heater, a second regenerator, and a second cooler. This arrangement provides two gas cycles acting in the same direction at a 180° shift in phase. For thermal separation of the two cylinder members, the working gas connecting line from the heater to the expansion cylinder member for each gas cycle may consist partly of a straight tube of defined dimensions, operating as a pulsed tube.

A convenient embodiment of the invention contributes to the compact structure of the hot-gas engine in that a passage is formed between the expansion cylinder member and the compression cylinder member, a piston rod of the expansion piston being arranged so as to extend through the passage in pressure-tight engagement. This arrangement helps establish the hydraulic separation and, if necessary, thermal separation of the compression and expansion cylinder members.

Pressure tight support of the piston rod of the expansion piston in the passage is facilitated, in an advantageous embodiment of the invention, wherein the passage is formed in a connecting member which comprises at least a portion of the expansion cylinder member and at least a portion of the compression cylinder member. With this design, the passage can be provided in a one-piece connecting member.

A modification of the invention conveniently may provide for the piston rod of the expansion piston to be introduced movably through a bore in the compression piston, thereby further enhancing the compact structure of the hot-gas engine. This permits piston force to be transmitted from the expansion piston to a gear transmission.

A convenient further development of the invention permits the compression piston to move along the piston rod of the expansion piston because the piston rod of the expansion piston is passed movably through the compression piston.

A further modification of the invention conveniently may provide for the piston rod to be passed movably through an opening in a casing of the compression cylinder member. In this manner the piston rod of the expansion piston may be extended to the outside in the area of the compression cylinder member so as to be coupled to a connecting rod, for example.

A space saving design of the hot-gas engine results from a further development of the invention wherein a piston rod attached to the compression piston is formed with an opening through which the piston rod of the expansion piston extends.

The piston rod of the compression piston and the piston rod of the expansion piston together may be passed out of the compression cylinder member in an advantageous embodiment of the invention wherein the piston rod attached to the compression piston is passed in pressure tight fashion through the opening in the casing of the compression cylinder member.

In a preferred embodiment of the invention direct coupling of the movement of the compression piston with that of the expansion piston and the piston rod thereof is obtainable because the compression piston is formed with a cavity in which a buffer piston secured to the piston rod of the expansion piston is movable, thereby defining two buffer chambers in the cavity.

A power transmission gear between the piston rod of the expansion piston and the compression piston may be dispensed with in a further development of the invention which includes two buffer chambers formed in the cavity in such a way that movement in the cavity of the expansion piston and the buffer piston atttached to it leads to gas compression/gas expansion in the two buffer chambers so as to cause movement of the compression piston. As one part of the buffer chamber becomes smaller, excess pressure is generated inside the same and acts to push the compression piston. At the same time, the other part of the buffer chamber is enlarged so that negative pressure is generated inside the same acting to pull the compression piston. Movement of the compression piston always occurs when the force resulting from the pressure differential between the two buffer chamber sections exceeds the required compressive force.

In a convenient further development of the invention the pressure tight passage of the piston rod of the expansion piston out of the compression cylinder member can be facilitated in that a portion of the piston rod of the expansion piston extending beyond the compression cylinder member is received in a sealed interior space of an extension sleeve which is mounted on the outside of the compression cylinder member. As compared to the pressure tight passage of the piston rod of the expansion piston through a casing of the compression cylinder member, it is easy to seal and mount the extension sleeve by simple means on the cylinder member. Fastening permanent magnets on that portion of the piston rod of the expansion piston which extends beyond the compression cylinder member is a possibility to obtain magnetic coupling with an outer movable magnetic element surrounding the extension sleeve, or a linear generator with an outer stationary coil form surrounding the extension sleeve.

In a preferred embodiment of the invention a distal end of the piston rod of the expansion piston is received in the cavity of the compression piston, and the expansion cylinder member and the compression cylinder member are movably supported in a linear guide means. The hollow compression piston thus has only one pressure-tight piston rod opening at the side facing the expansion piston. The cylinder composed of the expansion and compression cylinder members can be supported for movement in a linear guide means. As the expansion piston moves, the cylinder starts to resonate and can accomplish work to the outside, while complete pressure tightness is maintained. With this embodiment, improved heat transmission can be exploited in the heaters and coolers since heaters, regenerators and coolers move together with the cylinder.

In a preferred embodiment of the invention the compression piston may be formed with a cavity and the piston rod of the expansion piston may extend through the cavity. Inside the cavity, a magnetic piston with magnetic means is disposed on the piston rod of the expansion piston. The magnetic means interact with further magnetic means, and opposed portions of the magnetic means and the further magnetic means have similar magnetic polarity. The hydraulic drive by means of the buffer piston thus is replaced by a phase-shifted magnetic drive of the compression piston. The magnetic piston need not be sealed in the compression piston. A magnetic drive thus is obtained. The drive of the compression piston is effected directly via the expansion piston. Net work can be tapped at the piston rod of the expansion piston without any need for the customary gearing. The magnetic means and the further magnetic means facilitate adjustment of the required phase shift between the expansion piston and the compression piston, as compared to the embodiment described above which includes the buffer piston in the compression piston. This is so because only when the distance between opposite portions of the magnetic means and further magnetic means becomes very small, a repelling force reaches such a level that it causes the compression piston to move. The compressive pressures needed can be adjusted by suitable selection of the magnetic means and further magnetic means.

The further magnetic means may be arranged at least partly in the area of front end surfaces of the compression piston, thus contributing to the compactness of the hot-gas engine.

Both hydraulic and magnetic drives of the compression piston are advantageous in comparison with a mechanical drive since the compressive force need not be transmitted through gearing.

This means that it is possible to tap net work from the piston rod of the expansion piston.

An advantageous modification of the invention provides for efficient exploitation of the energy used to heat the expansion cylinder member. That is achieved by a compact heater which includes a cylindrical basic body designed as an integral structural component with a combustion chamber and a heat transmission surface for working gas, The heat transmission surface for working gas is provided in the form of a spiral in a surface layer of the cylindrical basic body. The spiral-shaped surface design helps create heat transmission conditions which are both favorable for heat flow and also save space. The courses of the spirals can be closed and connections for working gas be provided by means of sleeves which are shrunk on the cylindrical basic body and on which gas pipe connections are provided. An inner sleeve which, at the same time, defines the combustion chamber may be closed at one end, leaving free at the bottom a defined area of the course of the flue gas spiral so as to present a chamber for deflecting the flue gas.

Advantageously, respective heat transmission surfaces for combustion air and flue gas may be given the shape of spirals in a surface area of the cylindrical basic body.

A further development of the invention allows to use the compact heater for two working gases. The heat transmission surface for working gas, in this case, comprises one working gas spiral for a first working gas and at least one other working gas spiral, hydraulically separated from the first one, for a second working gas. In this manner a single compact heater can be utilized for operation of the hot-gas engine embodiments described above.

Manufacturing of the compact heater is facilitated by another modification of the invention with which the heat transmission surface for working gas is formed on an outer circumference of the cylindrical basic body.

Provision of the heat transmission surface for combustion air on the outer circumference of the cylindrical basic body, in accordance with yet another modification of the invention, is a further contribution to a space-saving design of the compact heater.

Optimized exploitation of the surface of the cylindrical basic body is warranted by a further preferred development of the invention according to which the heat transmission surface for flue gas is formed on an inner circumference of the cylindrical basic body.

In the case of another modification of the invention it is convenient that the heat transmission surface for working gas is provided in an area around the combustion chamber and the heat transmission surface for combustion air is provided in an area above the combustion chamber of the cylindrical basic body, the arrangement being such that the thermal energy generated in the combustion chamber can first heat the heat transmission surface for working gas and subsequently the heat transmission surface for combustion air. What this means is that the thermal energy generated with the aid of fuel in the combustion chamber is exploited efficiently in operating the hot-gas engine.

In a preferred further development of the invention the cylindrical basic body is made of two basic body components which are connected by a disc-shaped perforated element. The disc-shaped perforated element comprises a connecting conduit for directing combustion air into the combustion chamber and a flue gas connecting conduit for connecting heat transmission surfaces for flue gas in the two basic body components. This design allows one of the two basic body components to be provided with a continuous spiral-shaped heat transmission surface for combustion air. As this spiral may be shaped by turning, the expensive milling of the heat transmission surface can be dispensed with.

The invention will be described further, by way of example, with reference to the accompanying drawings, in which.

Figure 1:
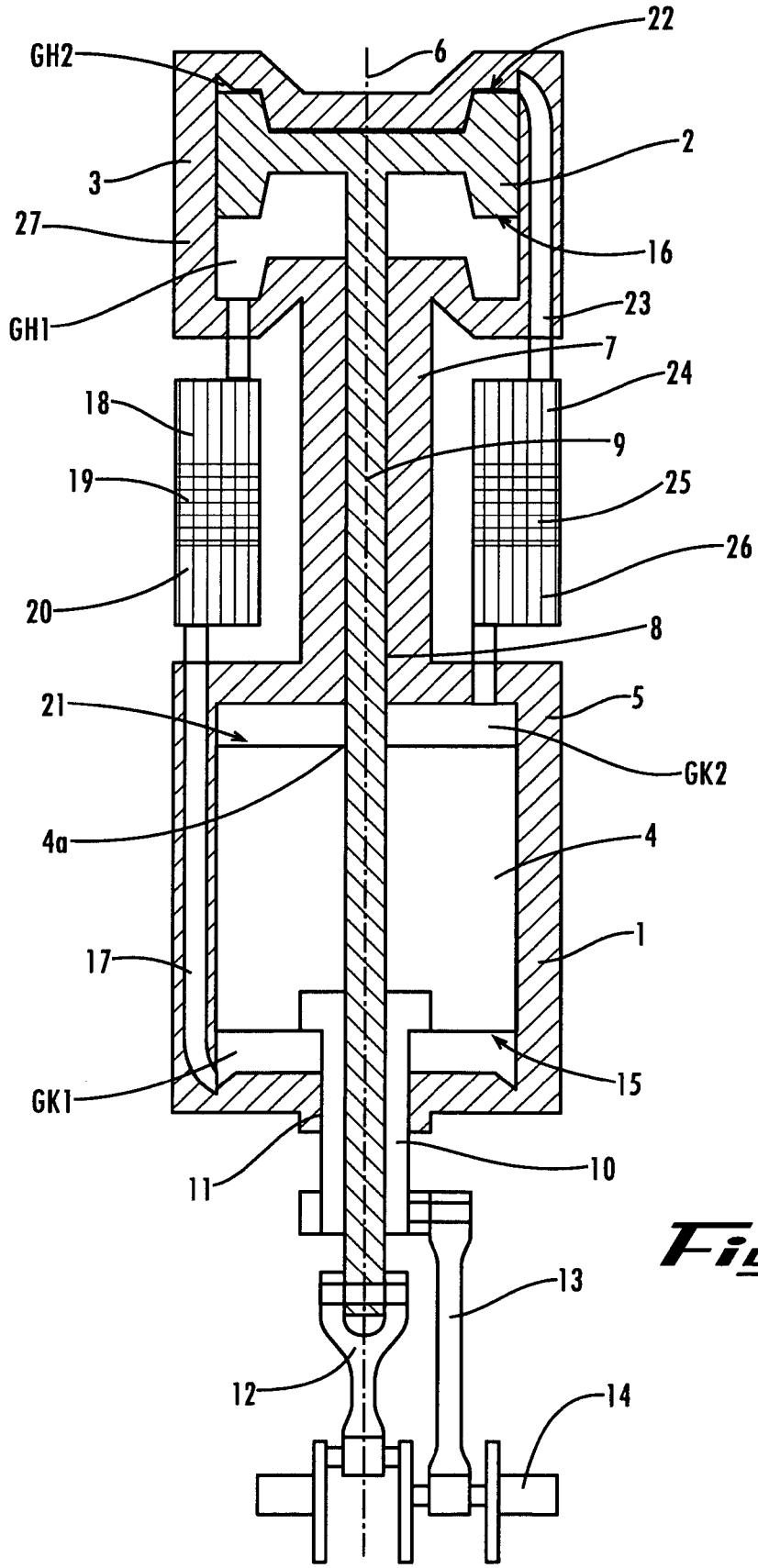
FIG. 1 is a diagrammatic presentation of a two-cycle hot-gas engine in cross section.

FIG. 1 diagrammatically shows a two-cycle hot-gas engine comprising a cylinder casing 1. The cylinder casing 1 houses an expansion piston 2 in an expansion cylinder member 3 and a compression piston 4 in a compression cylinder member 5. The expansion piston 2 and the compression piston 4 are disposed one behind the other along a common axis 6. The expansion cylinder member 3 and the compression cylinder member 5 are connected through a connecting member 7 which is formed with a passage 8. A piston rod 9 of the expansion piston 2 is guided in pressure tight fashion in the passage 8. The piston rod 9 of the expansion piston 2 extends through an opening 4*a* into the compression piston 4 and through both the compression piston 4 and a piston rod 10 of the compression piston 4.

The piston rod 10 of the compression piston 4 is passed to the outside through an opening 11 in the compression cylinder member 5. The passage of the piston rod 10 of the compression piston 4 and the piston rod 9 of the expansion piston 2 supported in the compression piston 4 out of the compression cylinder member 5 is pressure tight. The piston rod 9 of the expansion piston 2 is passed through an opening 10*a* in the piston rod 10. A connecting rod 12, 13 each is coupled to the piston rod 9 of the expansion piston 4 and the piston rod 10 of the compression piston 4, respectively, whereby the piston rods 9, 10 are connected to a crankshaft 14.

First gas chambers GH1 and GK1 are formed at a bottom end 15 of the compression piston 4 and a bottom end 16 of the expansion piston 2, respectively. The first gas chambers GH1 and GK1 are interconnected through a first connecting passage 17 through which they communicate with each other. A first heater 18, a first regenerator 19, and a first cooler 20 are integrated in the connecting passage 17.

Second gas chambers GK2 and GH2 are formed at a top end 21 of the compression piston 4 and a top end 22 of the expansion piston 2, and are interconnected through a second connecting passage 23. A second heater 24, a second regenerator 25, and a second cooler 26 are arranged in the second connecting passage 23.

In the two-cycle hot-gas engine illustrated in FIG. 1 the compression cylinder member 5 and the expansion cylinder member 3 are thermally separated. Because of this thermal separation, the piston rods 9 and 10 can be passed to the outside at the cold end of the hot-gas engine in the area of the compression cylinder member 5. Hereby problems of sealing which frequently occur in the prior art can be mitigated substantially.

The expansion cylinder member 3 and the expansion piston 2 may be made of high temperature resistant material. Heat pipe and gas channels (not shown in FIG. 1) formed in a wall 27 of the expansion cylinder member 3 of this embodiment allow the gas chambers GH1, GH2 to be heated isothermally. The compression cylinder member 5 may be made, for example, of Duran glass. The compression piston 4 conveniently is made of graphite.

Figure 2:
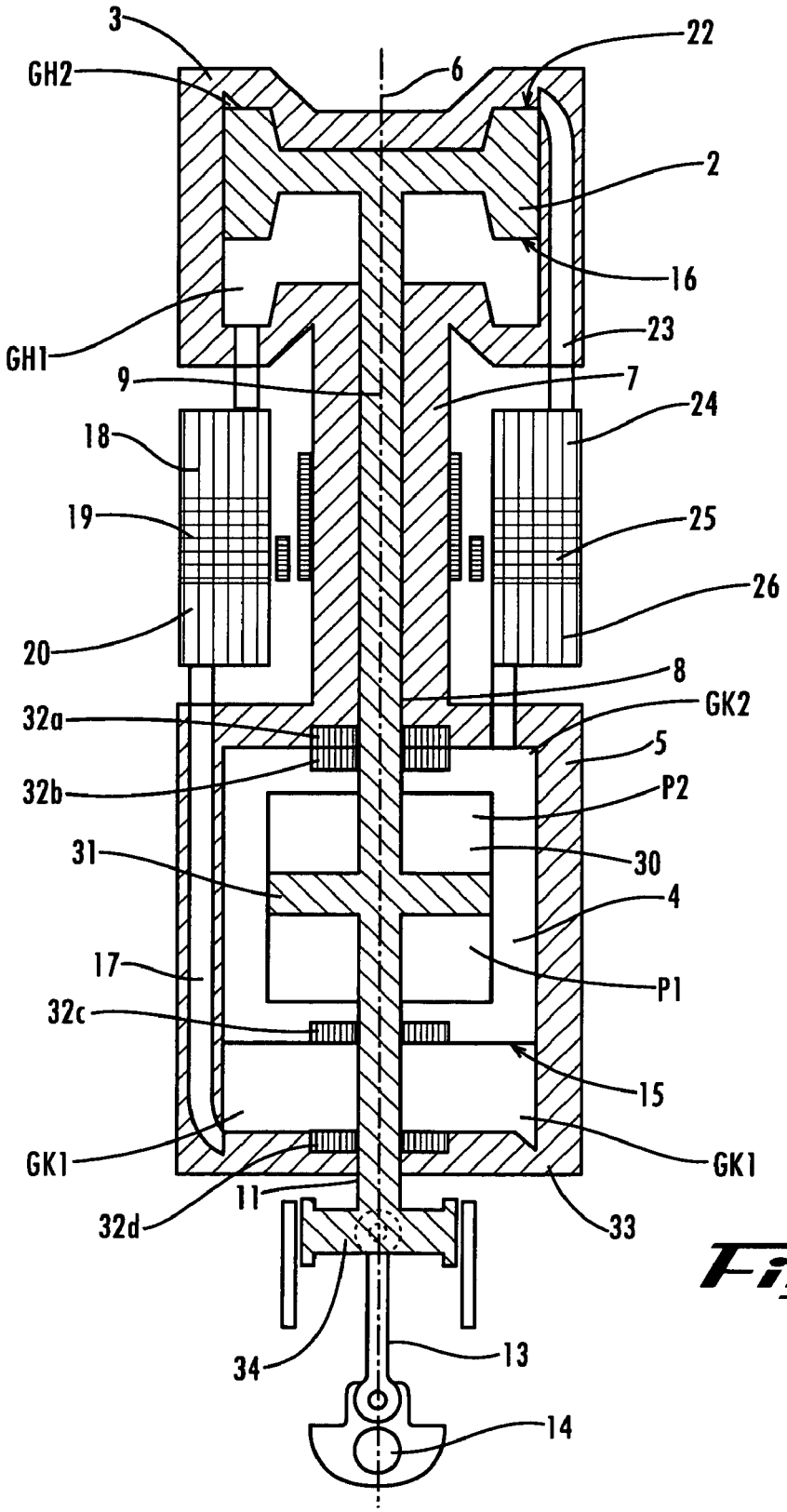
FIG. 2 is a diagrammatic presentation of a two-cycle hot-gas engine in cross section, a compression piston comprising a cavity.

FIG. 2 is a diagrammatic view of a two-cycle hot-gas engine in which the same reference numerals as in FIG. 1 are used to designate the same features. Other than with the two-cycle hot-gas engine shown in FIG. 1, the compression piston 4 has a cavity 30. A buffer piston 31 formed on the piston rod 9 of the expansion piston 2 is disposed inside the cavity 30. The buffer piston 31 defines buffer chambers P1 and P2 in the cavity 30. Upon movement of the expansion piston 2, working gas inside the buffer chambers P1, P2 is compressed/expanded and that results in upward and downward movements, respectively, of the compression piston 4. Thus gas chambers GH1, GH2 lead gas chambers GK1, GK2 in defined manner. Magnets 32*a*–32*d* prevent the compression piston 4 from hitting a casing 33 of the compression cylinder member 5. To this end the magnets 32*a* and 32*b* as well as 32*c* and 32*d*, respectively, have opposite magnetic poles.

Provision of the buffer piston 31 in the embodiment according to FIG. 2 makes it possible to dispense with a gear transmission to couple the piston rod 9 of the expansion piston 2 with the compression piston 4. The coupling is established by the buffer piston 31 in cooperation with the buffer chambers P1, P2 defined by it. In FIG. 2 the piston rod 9 of the expansion piston 2 is coupled to the connecting rod 13 by a crosstail 34.

Figure 3:
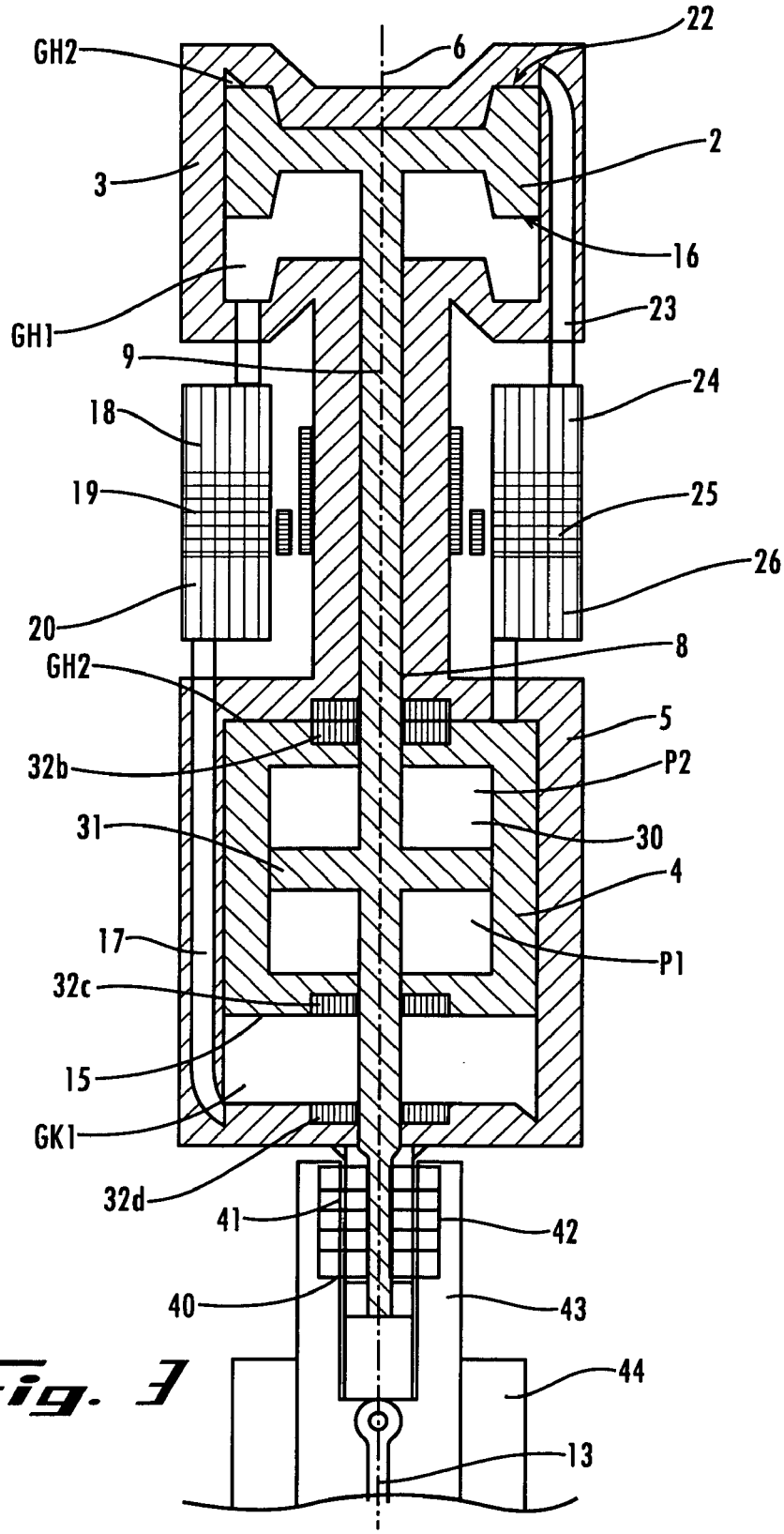
FIG. 3 shows the two-cycle hot-gas engine of FIG. 2, an end of a piston rod of an expansion piston being received in an extension sleeve.

FIG. 3 shows the two-cycle hot-gas engine of FIG. 2, but with an end 40 of piston rod 9 of the expansion piston 2, which end extends beyond the compression cylinder member 5, being received in an extension sleeve 41. The extension sleeve 41 is placed on the compression cylinder member 5 in pressure tight engagement. A magnetic coupling 42 couples the piston rod 9 of the expansion piston 2 to an external guide piston 43 which slides in a cylinder 44 of the guide piston 43. The guide piston 43 in turn is linked to the connecting rod 13. The guide piston 43 may be lubricated together with its cylinder 44 and be designed similar to an Otto carburetor engine.

Figure 4:
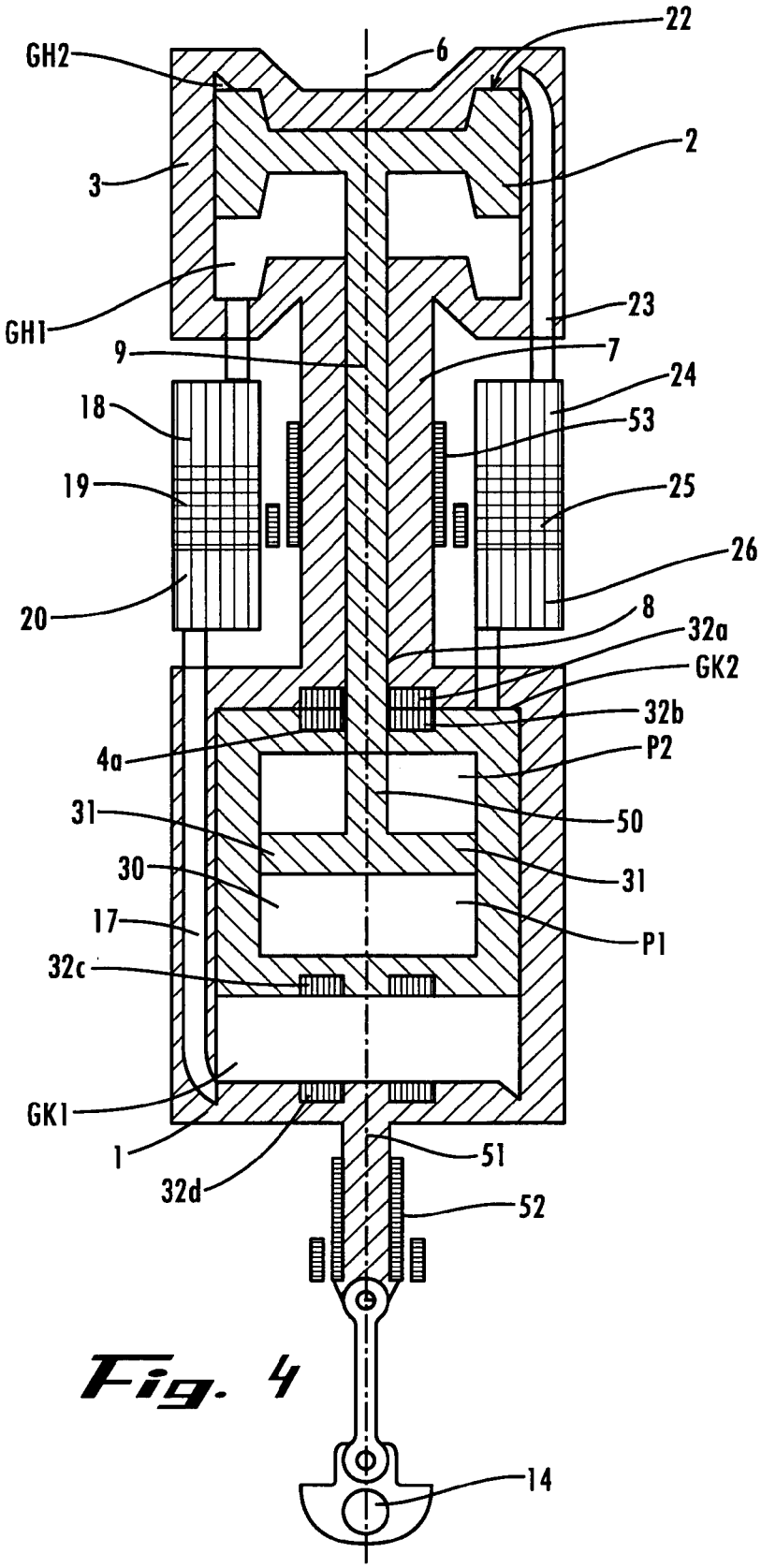
FIG. 4 is a diagrammatic presentation of a two-cycle hot-gas engine with linear guidance, in cross section.

FIG. 4 shows a different two-cycle hot-gas engine, but the same reference numerals as in FIGS. 1 to 3 are used for the same features. With the embodiment according to FIG. 4, a distal end 50 of the piston rod 9 of the expansion piston terminates at the buffer piston 31. In contradistinction to the embodiments shown in FIGS. 1 to 3, in the hot-gas engine of FIG. 4 there is no provision for passage of the piston rod 9 of the expansion piston 2 out of the compression cylinder member 5. The cylinder casing 1, therefore, is completely closed.

The compression cylinder member 5 is provided with an extension 51 which is movably supported in an element 52 of a linear guide means. The extension 51 is connected to the crankshaft 14 via the connecting rod 13. Another element 53 of the linear guide means is located in the range of the connecting member 7. The linear guide means assures rectilinear movement of the cylinder casing 1. The first cooler 18, first regenerator 19, first heater 20, the second cooler 24, second regenerator 25, and second heater 26 all move together with the cylinder casing 1. Transmission of a pulse to initiate movement of the compression piston 4 is assured by the gas compression in the buffer chambers P1, P2 as described with reference to the embodiments shown in FIGS. 2 and 3.

Figure 5:
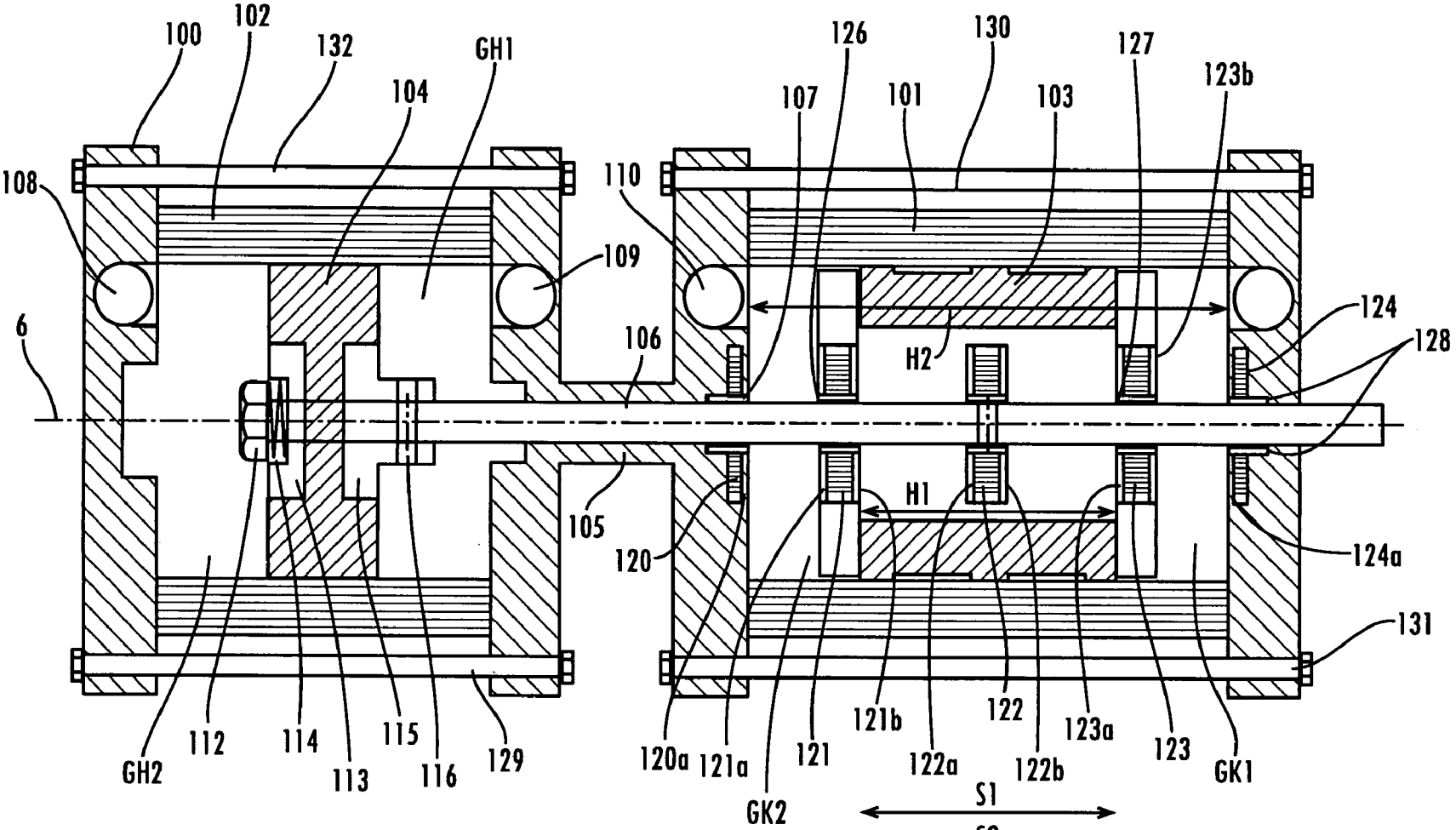
FIG. 5 is a diagrammatic presentation of a two-cycle hot-gas engine with magnetic drive, in cross section.

FIG. 5 is a diagrammatic presentation of another embodiment of a two-cycle hot-gas engine comprising a cylinder casing 100, a compression cylinder member 101, and an expansion cylinder member 102. The compression cylinder member 101 houses a compression cylinder 103. An expansion piston 104 is supported in the expansion cylinder member 102. The compression cylinder member 101 and the expansion cylinder member 102 are connected by a connecting member 105 in which a piston rod 106 of the expansion piston 104 is supported in pressure tight fashion. A seal 107 establishes the sealing effect.

As with the embodiments according to FIGS. 1 to 4, first and second gas chambers GH1, GK1 and GH2, GK2, respectively, are defined at either end of the compression piston 103 and of the expansion piston 104. Respective connections 108, 109, 110, and 111 are provided for each of the gas chambers. As explained in the description of FIGS. 1 to 4 heaters, regenerators, and coolers (not shown in FIG. 5) are positioned between the connections 108 to 111. The expansion piston 104 is held on the piston rod 106 by means of a piston fastening nut 112. A tension spring 114 is mounted between this nut and a piston clamping plate 113. Another piston clamping plate 115 is held on the piston rod 106 by a fastening pin 116.

The hot-gas engine illustrated in FIG. 5 differs from the embodiments according to FIGS. 1 to 4 by a magnetic drive of the compression piston 103. The magnetic drive comprises a plurality of magnetic means 121, 122, 123. These plural magnetic means 121, 122, 123 each dispose of disc-shaped pole plates 121*a*, 121*b*, 122*a*, 122*b*, 123*a*, 123*b*. Mutually opposed pole plates, such as pole plates 122*b* and 123*a*, have the same magnetic polarity so that repelling forces come to act when the opposed pole plates start to move towards each other. As a rule, however, the repelling forces do not exert great influence until the opposed pole plates actually approach each other. When comparing this embodiment with those illustrated in FIGS. 2 to 4, the provision of the magnetic drive obviates the need to seal the buffer piston 31 with respect to the compression piston 103 since the movement of the compression piston 103 is not initiated due to compression of gas in buffer chambers P1, P2 (cf. FIGS. 2 to 4) but instead by magnetic repulsion acting between opposite pole plates. Magnetic means 120, 124 which likewise dispose of pole plates 120*a*, 124*a* are provided in order to prevent the compression piston 103 from hitting the compression cylinder member 101.

The magnets 120 to 124 may be embodied by magnetic drums including bar magnets in an annular arrangement. A seal each 107, 126, 127, 128 around the piston rod 106 is provided in the vicinity of each of the magnets 120, 121, 122, 123, and 124 so that the piston rod 106 may pass in pressure tight engagement through the magnets 120, 121, 122, 123, and 124. Thus the seals 107, 126, 127, 128 separate the two cycles from each other. The magnet 122 is fixed on the piston rod 106. The seals 107, 126, 127, 128 are made of Teflon, for instance. The piston rod 106 of the expansion piston 104 is made of a non-magnetic material of poor electrical conductivity, such as V4A steel. The cylinder member is a multi-part member, the parts of which are held together by bolted connections 129, 130, 131, 132.

In FIG. 5 the length of stroke S1 of the expansion piston 103 is indicated diagrammatically. This length of stroke S1 of the expansion piston 103 can be adjusted to become bigger or smaller than or equal to a length of stroke S2 of the compression piston 104 by varying a hollow length H1 of the compression piston 103 and a hollow length H2 of the compression cylinder member 101. By these means it is possible to influence the compression ratio of the engine and the discontinuous piston movement of the compression piston 103.

Figure 6:
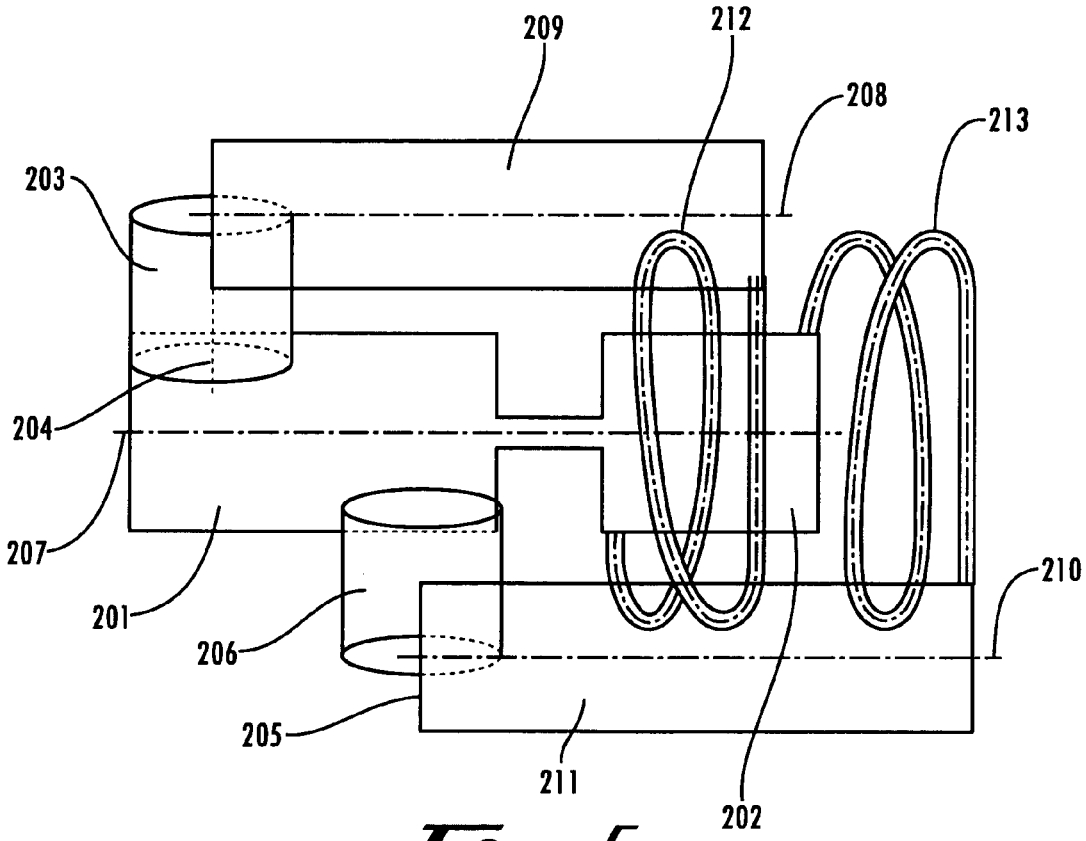
FIG. 6 is a diagrammatic presentation of a two-cycle hot-gas engine with an axis of a spiral heater extending parallel to an axis of a cylinder, in cross section.

FIG. 6 diagrammatically shows a two-cycle hot-gas engine 200 comprising a compression cylinder member 201 and an expansion cylinder member 202. A cooler 203 has an axis 204 which extends substantially parallel to an axis 205 of another cooler 206. The axis 204 of the cooler 203 and the axis 205 of the cooler 206 extend substantially at right angles to an axis 207 of the compression cylinder member 201 and the expansion cylinder member 202. An axis 208 of a regenerator 209 extends substantially parallel to an axis 210 of another regenerator 211 and the axis 207 of the compression cylinder member 201. FIG. 6 also shows two heater coils 212 and 213 disposed one after the other. For low power engines, the two heater coils 212, 213 may be embodied by single tube heaters or cylindrical slotted tube heaters. That offers the possibility of heating the gas chambers of both cycles of the engine with a single burner disposed within the two successive heater coils 212, 213. Therefore, the second burner otherwise needed can be saved.

Figure 7:
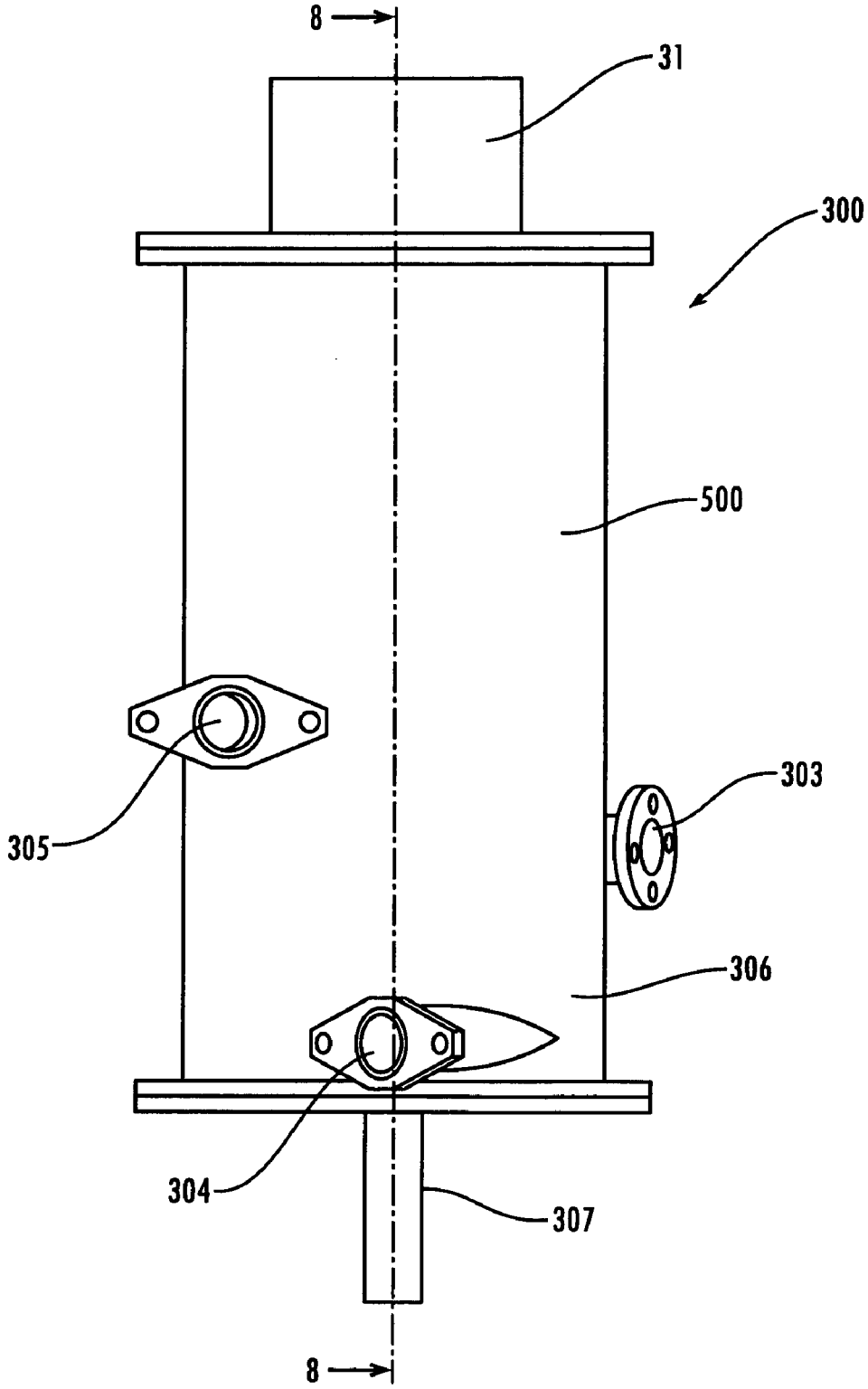
FIG. 7 shows a compact heater.

FIG. 7 shows a compact heater 300 which may be used in combination with any hot-gas engine. This means that the compact heater 300 is advantageous for use not only with the two-cycle hot-gas engines illustrated and described with reference to FIGS. 1 to 6. Its employment with beta and gamma engines is advantageous as well, provided the spiral connections are adaptable to the engine geometry.

The compact heater 300 comprises a cylindrical sleeve 500 provided with a combustion air connection 302, a first working gas connection 303, a second working gas connection 304, and a first working gas exit 305. A second working gas exit is located at the rear of the compact heater 300 (not visible in FIG. 7). A burner 307 is connected to the lower end 306 of the compact heater 300.

Figure 8:
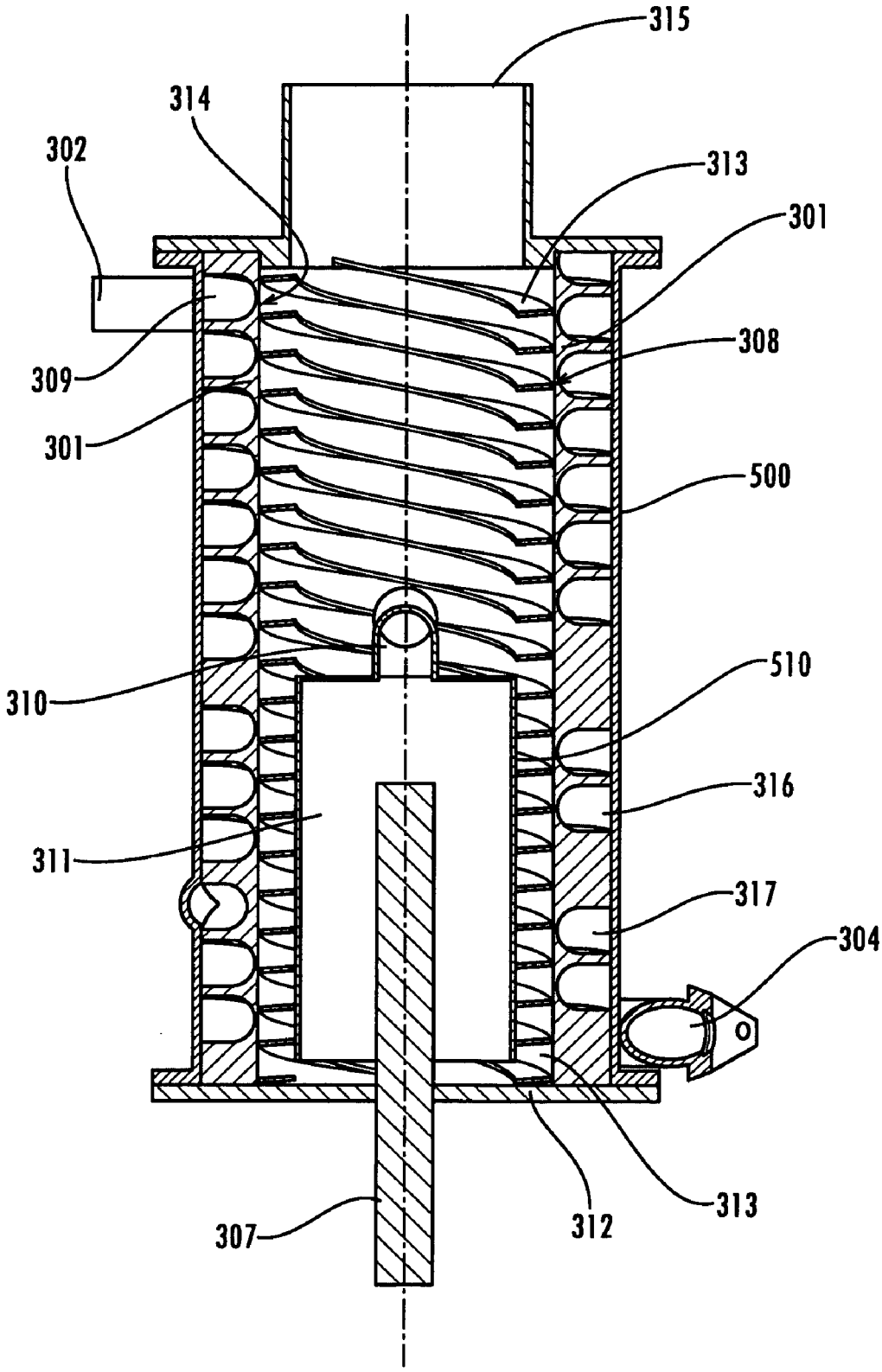
FIG. 8 shows the compact heater of FIG. 7 in section along line A–A' in FIG. 7.

FIG. 8 is a sectional elevation of the compact heater 300 according to FIG. 7 along line A–A' in FIG. 7, A heat transmission surface of spiral configuration for combustion air 309 is provided in the form of a channel on an outer circumference 308 of a cylindrical basic body 301. The spiral heat transmission surface for combustion air 309 communicates with the combustion air connection 302. Combustion air flows through the combustion air connection 302 to the spiral heat transmission surface for combustion air 309 and through a connecting pipe 310 into a combustion chamber 311 where fuel is burnt by means of the burner 307 to generate combustion heat energy. A blower may be connected upstream of the connection for combustion air 302 so as to introduce the combustion air at a predetermined pressure. The combustion in the combustion chamber 311 produces flue gas or exhaust gas which is transmitted by a deflection chamber plate 312 at the lower end of the combustion chamber 311 to a spiral heat transmission surface for flue gas 313 formed along a passage and extending helically along an inner circumference 314 of the cylindrical basic body 301. Flowing along the spiral heat transmission surface for flue gas 313, the flue gas finally reaches a chimney 315. On its way to the chimney 315 the flue gas first heats the working gas along heat transmission surfaces for working gas 316, 317 likewise provided on the outer circumference 308 of the cylindrical basic body 301. On its further path along the heat transmission surface for flue gas 313 the flue gas then will heat the heat transmission surface for combustion air 309.

Figure 9:
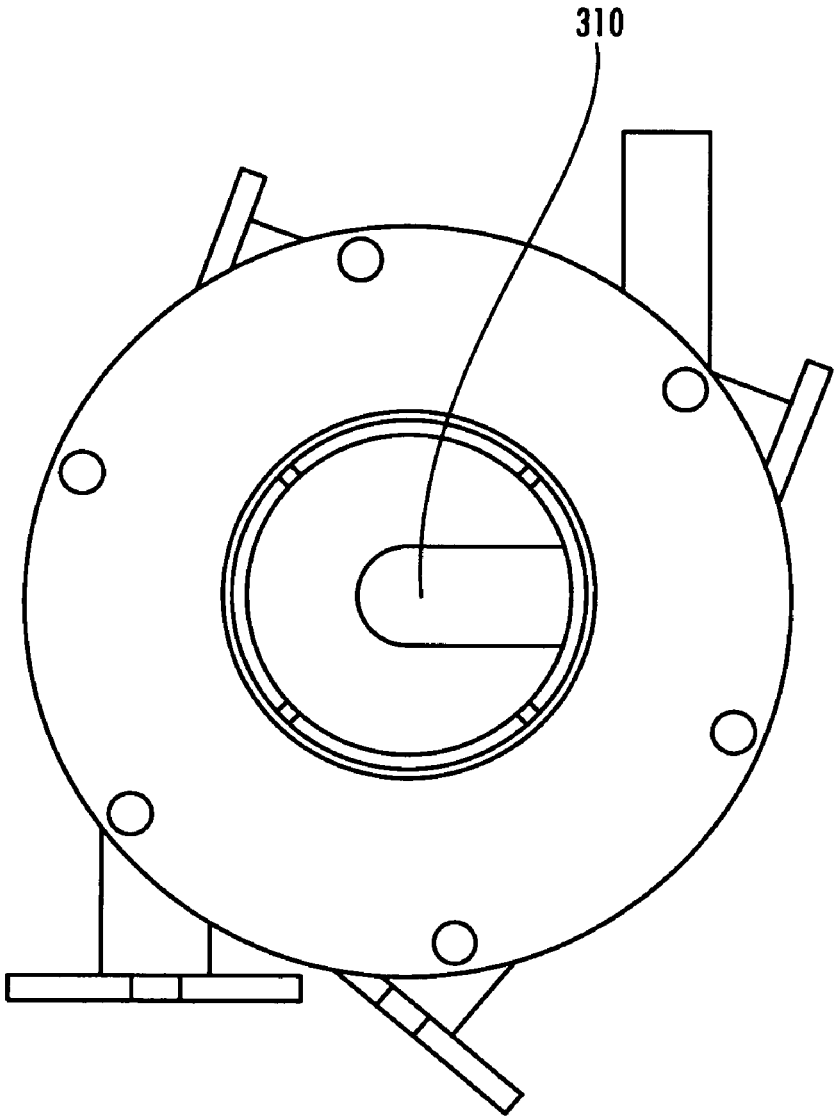
FIG. 9 shows the compact heater of FIG. 7 in top plan view.

FIG. 9 is a top plan view of the compact heater 300 illustrated in FIG. 7.

Figure 10:
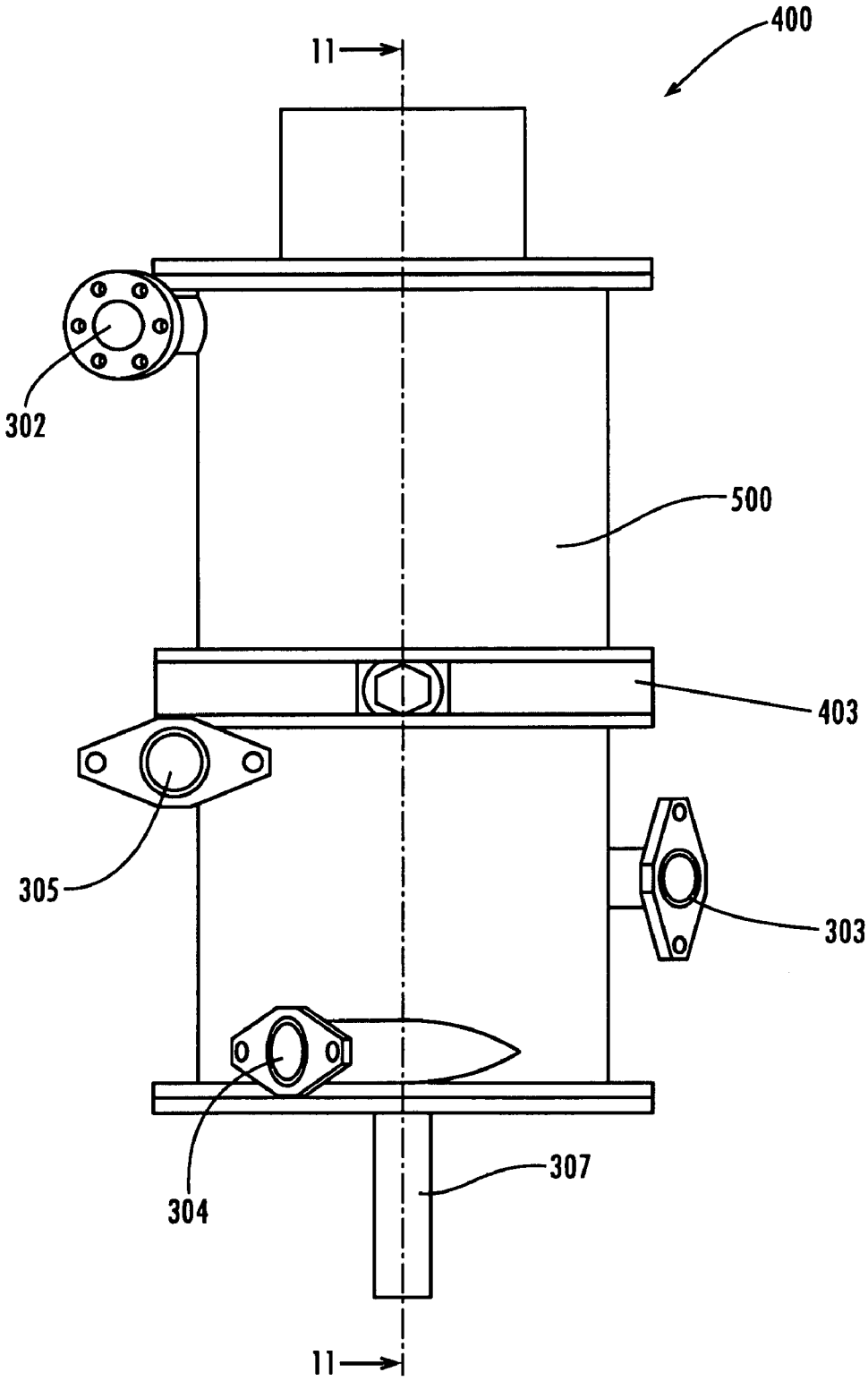
FIG. 10 shows another compact heater.
Figure 11:
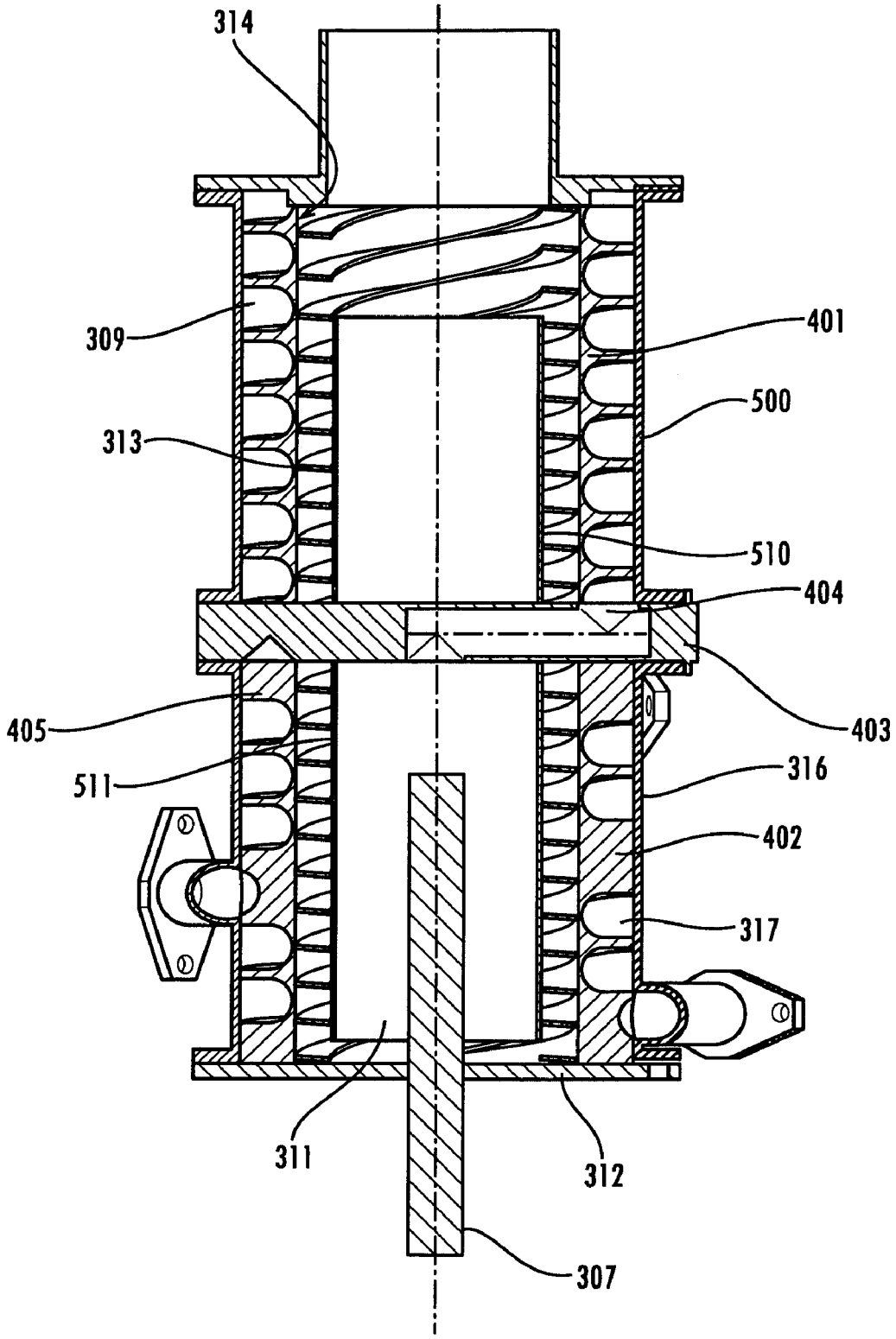
FIG. 11 shows the compact heater of FIG. 10 in section along line B–B' in FIG. 10.
Figure 12:
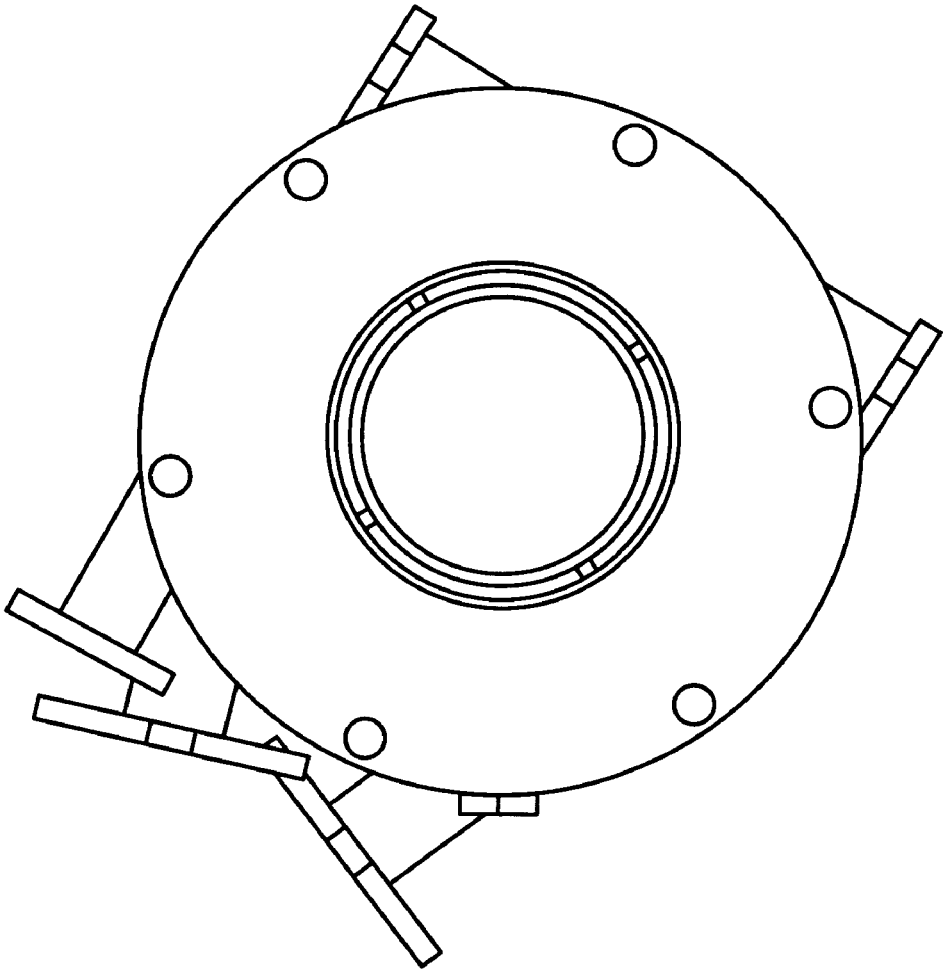
FIG. 12 shows the compact heater of FIG. 10 in top plan view.

FIGS. 10, 11, and 12 show another compact heater 400. Like features are indicated by the same reference numerals as used in FIGS. 7, 8, and 9. In the embodiment according to FIGS. 10 to 12 the cylindrical basic body 301 is made up of two basic body components 401 and 402 which are hidden in FIG. 10. The two basic body components 401 and 402 are connected through a perforated element 403. As shown in FIG. 11, in the perforated element 403 there is a combustion air connecting passage 404 through which combustion air can get from the spiral heat transmission surface for combustion air 309 into the combustion chamber 311. The combustion air connecting passage 404 of the embodiment according to FIGS. 10 to 12 thus fulfills the function of the connecting passage 310 in FIG. 8. Two inner sleeves 510, 511 are mounted on the inner circumference 314 of the basic body components 401, 402.

FIG. 12 is a top plan view of the compact heater shown in FIG. 10.

It is possible to use a single-tube heater for low power hot-gas engines performing at rotational speeds of between 100 and 500 rpm. The compact heater 300 illustrated in FIGS. 7 to 9 as well as the other compact heater 400 of FIGS. 10 to 12 belong to this category of single-tube heaters. The main reason for employing single-tube heaters is that the cost of the heater decisively influences the overall system cost of hot-gas engines already built.

The spiral configuration of the heat transmission surfaces of the compact heater 300 and the other compact heater 400 is suitable for a design as a single-tube heater. At the present situation, manufacturing the compact heaters 300 and 400 of a high temperature resistant metal would be an advantageous solution, provided the requirements of high temperature loading capacity, tinderproofness, and sufficiently tight sealing of the connections are fulfilled.

The cylindrical basic body 301 of the compact heater 300 and the other compact heater 400 can be produced in a casting mold which would also comprise the spiral heat transmission surfaces. Appropriate wall thicknesses and mold slopes of the spiral channels which are to constitute the heat transmission surfaces must be taken into consideration. If the operating temperature does not exceed 600ø C. a convenient solution would be to use as charge metal spheroidal graphite cast iron alloyed with SiMo. Another possibility of making the cylindrical basic body 301 is to subject it to turning and/or milling in order to obtain the spiral channels in the inner and outer circumferences 314, 308. In this case a cylindrical high temperature hollow steel may be employed. An outer sleeve 500 is shrunk on so as to close the spiral heat transmission surfaces provided on the outer circumference 308. The inner sleeve 511 also is applied by shrinking so as to cover the heat transmission surface for flue gas 313. The sleeve 500 is shrunk together with the connections 302 to 305. Shrinking can be applied because, with both the compact heater 300 and the other compact heater 400, the heat of the burner 307 always is supplied from the inside. Tightness is assured in view of the fact that first the inner sleeve 510, then the cylindrical basic body 301, and finally the outer sleeve 500 will expand, As cooling takes place from the outside to the inside, this likewise is not critical as far as tight sealing of the spiral heat transmission surfaces is concerned.

The compact heater 300 and the other compact heater 400 permit compact-structure heaters to be built which may be used for any kind of hot-gas engine. The design specified above allows cost efficient production. Furthermore, favorable heat transmission conditions are provided and pressure losses will be low. The embodiment of the heat transmission surface for working gas described with reference to FIGS. 7 to 12 makes it possible to provide at least two working gas chambers which are heated by a single burner. It is possible to use high temperature castings. If the compact heater 300 and the other compact heater 400 are employed in the upright orientation illustrated in FIGS. 7, 8 and 10, 11, respectively, the flue gas can be passed on directly to the chimney.

Figure 13:
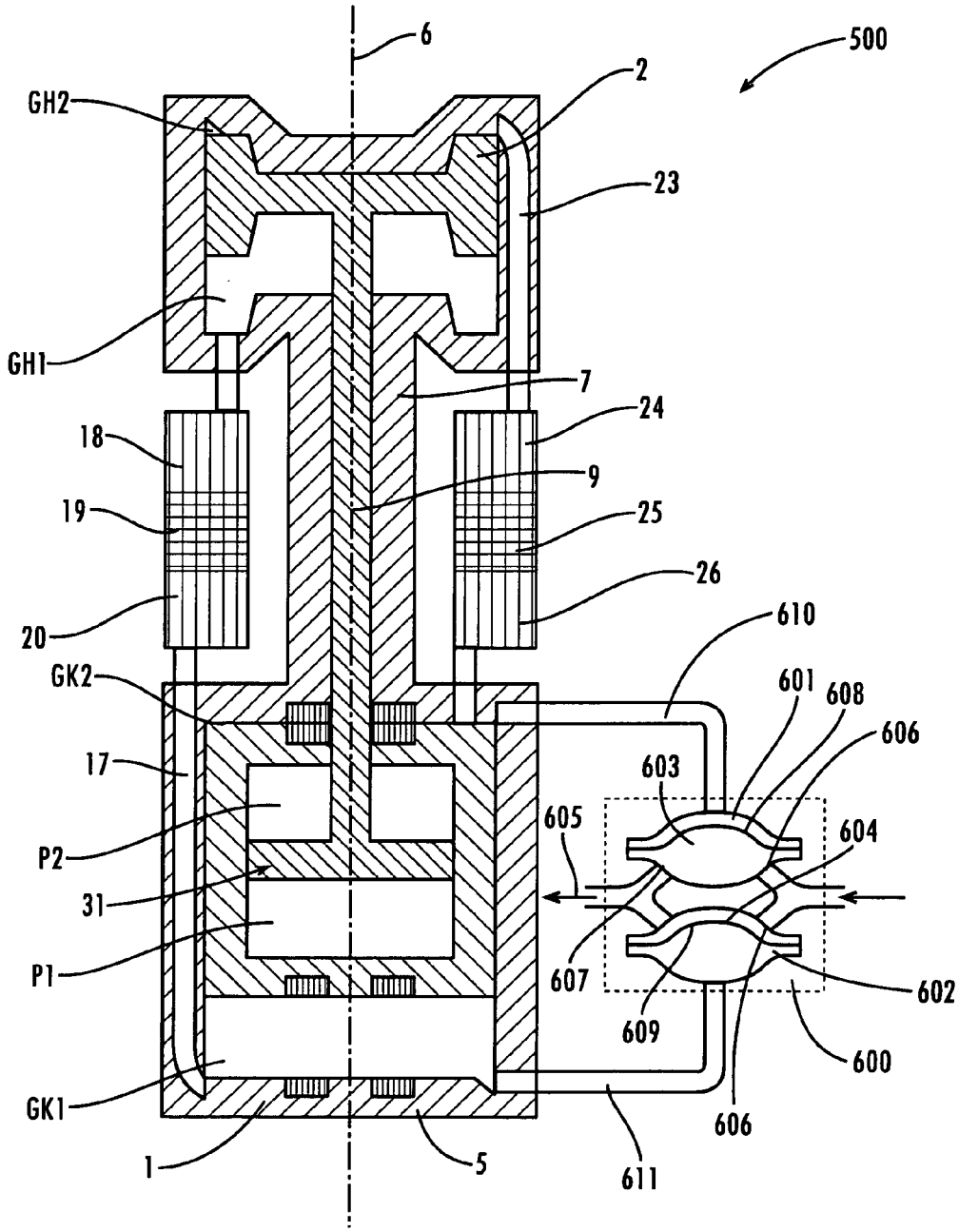
FIG. 13 is a diagrammatic presentation of a two-cycle hot-gas engine.

FIG. 13 is a diagrammatic illustration of a two-cycle hot-gas engine 500 connected to a machine 600. The reference numerals of FIGS. 1 to 5 will be used to indicate like features. Two primary diaphragm sides 601, 602 communicate hydraulically through two gas pipes 610, 611 with the working gas of the two-cycle hot-gas engine 500 and are caused to vibrate by pressure variations of the working gas. Two secondary diaphragm sides 603, 604 are designed as pump working chambers. The diaphragm thus pumps a liquid 605 in that positive pressure will open at least one outlet valve 607 and close at least one inlet valve 606, while negative pressure will close at least one outlet valve 607 and open at least one inlet valve 606.

It is advantageous for this application that the two-cycle hot-gas engine 500 is an engine which causes two hydraulically separated diaphragms 608, 609 or deformable surfaces to vibrate at a shift in phase of 180° by means of its two working gas chambers. In this manner the work yield can be duplicated and pulse smoothing is obtained.

Instead of operating with mechanical transmission of force, the two-cycle hot-gas engine 500 utilizes the working gas pressure variations of the engine to cause vibration of at least one diaphragm, the primary side of which is influenced by the working gas, said diaphragm belonging to a machine or a drive means or being embodied by the piezoelectric surface of a power generator. Conveniently, the machine 600 may be a double acting diaphragm pump having the primary diaphragm sides in hydraulic connection with the engine working gas so that the pressure variations thereof will cause the diaphragms to vibrate.

In connection with the two-cycle hot-gas engine 500 it is advantageous, when a power generator is concerned, to have a hydraulic connection between the deformable surface of a piezoelectric transducer and the engine working gas so that the surface will be cyclically deformed by the pressure variations thereof.

The application in practice of the two-cycle hot-gas engine 500 described with reference to FIG. 13 may be provided also for the engines illustrated in FIGS. 1 to 6.

The features of the invention disclosed in the specification above, in the claims and drawings may be essential for implementing the invention in its various embodiments, both individually and in any combination.

What is claimed is:

1. A two-cycle hot-gas engine comprising:

an expansion piston (2; 104) in an expansion cylinder member (3; 102) and a compression piston (4; 103) in a compression cylinder member (5; 101), the expansion piston (2; 101) and the compression piston (4; 103) being disposed along a common axis (6);

first gas chambers (GH1 and GK1, respectively) formed at a bottom end (15) of the compression piston (4) in the compression cylinder member (5) and at a bottom end (16) of the expansion piston (2) in the expansion cylinder member (3), respectively;

the first gas chambers communicating with each other through a first heater (18), a first regenerator (19) and a first cooler (20);

second gas chambers (GH2 and GK2, respectively) formed at a top end (21) of the compression piston (4) in the compression cylinder member (5) and at a top end (22) of the expansion piston (2) in the expansion cylinder member (3), respectively; and the second gas chambers communicating with each other through a second heater (24), a second regenerator (25), and a second cooler (26).

2. The two-cycle hot-gas engine as claimed in claim 1, characterized in that the expansion piston (2; 104) and the compression piston (4; 103) are disposed so as to operate in alignment one behind the other.

3. The two-cycle hot-gas engine as claimed in claim 1, characterized in that a passage (8) is formed between the expansion cylinder member (3) and the compression cylinder member (5), a piston rod (9; 106) of the expansion piston (2) being arranged to extend through the passage (8) in pressure-tight engagement.

4. The two-cycle hot-gas engine as claimed in claim 3, characterized in that the passage (8) is formed in a connecting member (7; 105) which comprises at least a portion of the expansion cylinder member (3; 102) and at least a portion of the compression cylinder member (5; 101).

5. The two-cycle hot-gas engine as claimed in claim 1, characterized in that the piston rod (9; 106) of the expansion piston (2; 104) is movably introduced into the compression piston (4; 103) through a bore (4*a*) in the compression piston (4; 103).

6. The two-cycle hot-gas engine as claimed in claim 5, characterized in that the piston rod (9; 106) of the expansion piston (2; 104) is movably passed through the compression piston (4; 103).

7. The two-cycle hot-gas engine as claimed in claim 6, characterized in that the piston rod (9; 106) of the expansion piston (2; 104) is movably passed through a bore (11) in a casing of the compression cylinder member (5; 101).

8. The two-cycle hot-gas engine as claimed in claim 6, characterized in that a piston rod (10) attached to the compression piston (4) is formed with an opening (10*a*) through which the piston rod (9) of the expansion piston (2) is passed.

9. The two-cycle hot-gas engine as claimed in claim 7, characterized in that the piston rod (10) attached to the compression piston (4) is passed in pressure-tight engagement through the bore (11) in the casing of the compression cylinder member (5).

10. The two-cycle hot-as engine as claimed in claim 1, characterized by a compact heater (300; 400) including a cylindrical basic body (301) designed as an integral structural component with a combustion chamber (311) and a heat transmission surface for working gas, said heat transmission surface for working gas being formed in spiral shape in a surface layer of the cylindrical basic body (301).

11. The two-cycle hot-gas engine as claimed in claim 10, characterized in that respective heat transmission surfaces for combustion air and flue gas are provided in spiral configuration in the range of a surface of the cylindrical basic body (301).

12. The two-cycle hot-gas engine as claimed in claim 11, characterized in that the heat transmission surface for combustion air is provided on the outer circumference (308) of the cylindrical basic body (301).

13. The two-cycle hot-gas engine as claimed in claim 11, characterized in that the heat transmission surface for flue gas is provided on an inner circumference (314) of the cylindrical basic body (301).

14. The two-cycle hot-gas engine as claimed in claim 11, characterized in that the heat transmission surface for working gas in an area around the combustion chamber (311) and the heat transmission surface for combustion air in an area above the combustion chamber (311) of the cylindrical basic body (301) are arranged such that the thermal energy generated in the combustion chamber (311) can first heat the heat transmission surface for working gas and subsequently heat the heat transmission surface for combustion air.

15. The two-cycle hot-gas engine as claimed in claim 10, characterized in that the heat transmission surface for working gas comprises a working gas spiral for a first working gas and at least one other working gas spiral, hydraulically separated from the working gas spiral, for a second working gas.

16. The two-cycle hot-gas engine as claimed in claim 10, characterized in that the heat transmission surface for working gas is provided on an outer circumference (308) of the cylindrical basic body (301).

* * * * *